US009523509B2

(12) United States Patent
Baldwin et al.

(10) Patent No.: US 9,523,509 B2
(45) Date of Patent: Dec. 20, 2016

(54) ADJUSTABLE ROOF VENT

(71) Applicant: Canplas Industries Ltd., Barrie (CA)

(72) Inventors: Norman Scott Baldwin, Innisfil (CA); James Brian Mantyla, Barrie (CA); Lawrence William Stagg, Barrie (CA)

(73) Assignee: Canplas Industries Ltd., Barrie (CA)

( * ) Notice: Subject to any disclaimer, the term of this patent is extended or adjusted under 35 U.S.C. 154(b) by 985 days.

(21) Appl. No.: 13/723,597

(22) Filed: Dec. 21, 2012

(65) Prior Publication Data

US 2014/0106661 A1 Apr. 17, 2014

(30) Foreign Application Priority Data

Oct. 15, 2012 (CA) ..... 2792461

(51) Int. Cl.

| | |
|---|---|
| ***F24F 7/02*** | (2006.01) |
| ***F24F 13/10*** | (2006.01) |
| ***F24F 13/28*** | (2006.01) |
| ***F24F 13/14*** | (2006.01) |
| ***E04D 13/147*** | (2006.01) |
| *F24F 13/08* | (2006.01) |

(52) U.S. Cl.

CPC ..... *F24F 7/02* (2013.01); *E04D 13/1471* (2013.01); *F24F 13/10* (2013.01); *F24F 13/14* (2013.01); *F24F 13/28* (2013.01); *F24F 13/082* (2013.01)

(58) Field of Classification Search

CPC .... E04D 13/1471; E04D 13/17; E04D 13/174; F24F 7/02; F24F 13/10; F24F 13/14; F24F 13/28; F24F 13/082

USPC ..... 454/250, 260, 358, 364, 365, 366

See application file for complete search history.

(56) References Cited

U.S. PATENT DOCUMENTS

| | | | |
|---|---|---|---|
| 1,588,321 | A | 6/1926 | Lord |
| 2,274,403 | A | 2/1942 | Filkins |
| 2,695,554 | A | 11/1954 | Jenson et al. |
| 2,763,196 | A | 9/1956 | Singleton |
| 2,890,642 | A | 6/1959 | Fernsten et al. |
| 2,909,113 | A | 10/1959 | Hatcher |
| 3,075,450 | A | 1/1963 | Noll |

(Continued)

*Primary Examiner* — Gregory Huson
*Assistant Examiner* — Dana Tighe
(74) *Attorney, Agent, or Firm* — Hoffmann & Baron, LLP

(57) ABSTRACT

A passive vent for venting a building enclosure having an opening in a roof portion, the vent being adjustable for mounting on roof portions of different slopes. The vent has a base pivotally attached to a vent structure with a pair of pivot joints. The vent structure has a collar attached to a vent body having a cover. At least one gas permeable screen is positioned on the vent body between the cover and the collar. The base comprises a lower attachment structure for attaching the base to the roof portion over the opening. An aperture through the lower attachment structure permits gas to pass in to and out of the opening in the roof portion through the base. A wall including a pair of opposed curvilinear wall sections surrounds the aperture. The pivot joints define a pivot axis about which the vent structure pivots along a range of angles relative to the base. The collar is sized and shaped to overlap portions of the aperture surrounding wall to maintain a continuous wall between the collar and the aperture surrounding wall along the range of angles. At least one securement means secures the vent structure in one of the range of angles relative to the base.

32 Claims, 13 Drawing Sheets

(56) References Cited

U.S. PATENT DOCUMENTS

| | | | | | |
|---|---|---|---|---|---|
| 3,082,677 | A | | 3/1963 | Pease | |
| 3,886,852 | A | | 6/1975 | Acosta | |
| 4,833,853 | A | * | 5/1989 | Deibele | E04D 5/142 52/410 |
| 5,149,301 | A | * | 9/1992 | Gates | F24F 7/02 454/365 |
| 5,409,266 | A | | 4/1995 | Baker | |
| 5,655,964 | A | | 8/1997 | Rheault et al. | |
| 5,839,233 | A | * | 11/1998 | Smit | E06B 7/086 454/250 |
| 6,155,008 | A | * | 12/2000 | McKee | E04D 13/0325 52/198 |
| 6,932,690 | B2 | * | 8/2005 | Ramsay | E04D 13/147 285/44 |
| 7,232,370 | B1 | | 6/2007 | Newell | |
| 2003/0153262 | A1 | * | 8/2003 | Mantyla | E04D 13/17 454/367 |
| 2009/0053990 | A1 | * | 2/2009 | McKee | F24F 7/02 454/250 |

* cited by examiner

ADJUSTABLE ROOF VENT

CROSS-REFERENCE TO RELATED APPLICATIONS

This claims the benefit of Canadian Application No. 2,792,461, filed Oct. 15, 2012, the contents of which is incorporated by reference herein.

FIELD OF THE INVENTION

The present invention relates to building products and in particular to ventilation devices which are used in buildings to provide for circulation of air between an exterior and an interior or closed in portion of the building. More particularly this invention relates to vents that are used to permit ventilation of attics or other spaces under a roofed area and which are referred to as passive roof vents.

BACKGROUND OF THE INVENTION

Virtually all buildings and structural enclosures where human activity takes place require venting. The type of venting device employed to provide the required venting will depend on the kind of enclosure to be vented and the use to which the vented space is put. For example, bathrooms containing showers typically have active vents with fans to vent moist air and steam to the outdoors. Kitchens, particularly in restaurants and hotels, similarly have powered vents for removing cooking by-products such as smoke and steam to the outdoors.

Other types of enclosures, such as attics, may not require active venting. However, such enclosures do typically require a passive venting device to allow for air flow from the enclosure, through an opening, to the outdoors. Such venting is required, for example, to prevent a buildup of moisture in the enclosure. Rather than forcing air out of the enclosure, passive venting devices typically include a vent structure in the form of upstanding walls defining an aperture to allow airflow between the enclosure and the outdoors. Passive venting devices can also include a screen to block animals, insects and other unwanted objects from entering the enclosed space through the opening in the building enclosure.

Passive venting devices are well-known and have been extensively used in the past. Notably, many jurisdictions have building codes that require passive venting devices for venting attic spaces. House attics and other similar enclosures are sometimes vented simply by one or more passive venting devices on the roof. The passive venting devices are each positioned above a ventilation passage or opening in the roof which permits air to flow from the enclosure to the outside, and vice versa.

Most roof vents are typically constructed for a given predetermined roof slope (or pitch) and area. Accordingly, roof vent suppliers are required to maintain a relatively large inventory of vents in order to accommodate the full range of roof slopes or pitches which are encountered in the building industry. Consequently, roof vent suppliers are faced with the problem of high costs and high storage space if they want to be able to supply roof vents accommodating the full range of roof slopes and venting requirements encountered in the industry.

Accordingly, there exists a need for an adjustable roof vent. The prior art has recognized the need for adjustability of roof vents, as evidenced by several patents disclosing different types of adjustable structures.

For example, U.S. Pat. No. 6,932,690 to Ramsay discloses an adjustable roof ventilator jack for operationally coupling a roof ventilator to a venting aperture extending through a sloped roof. The jack includes a base section having base section front, rear and side walls. The base section is configured so as to be angled in a direction opposite the slope of the roof. The jack also includes a pivotable section having pivotable section front and side walls. The pivotable section front wall is pivotally attached to the base section for pivotal movement between an extended configuration wherein the pivotable and base section front walls are in a substantially parallel relationship relative to each other and a retracted configuration wherein the inner surface of the pivotable and base section front walls form an obtuse angle. The jack further includes a position lock for selectively locking the base and pivotable sections in a predetermined angular relationship relative to each other.

U.S. Pat. No. 2,274,403 to Filkins discloses a chimney, ventilator, or exhaust head for a slope or ridge installation adapted to fit any pitch or slope of roof. The chimney includes an upwardly projecting flange at each side with a central projection for seating a bearing member at opposite sides of a cover-plate. The cover-plate has a skirt which may be uniform on both sides of its center mounting, and preferably two adjusting bolts are provided for holding the cover member in place.

Other prior art patents of general interest in the field of passive venting devices include: U.S. Pat. No. 1,588,321 to Lord, U.S. Pat. No. 2,695,554 to Jenson, U.S. Pat. No. 2,763,196 to Singleton, U.S. Pat. No. 2,890,642 to Fernsten, U.S. Pat. No. 2,909,113 to Hatcher, U.S. Pat. No. 3,075,450 to Noll, U.S. Pat. No. 3,082,677 to Pease, U.S. Pat. No. 3,886,852 to Acosta, U.S. Pat. No. 5,409,266 to Baker, U.S. Pat. No. 5,655,964 to Rheault, and U.S. Pat. No. 7,232,370 to Newell.

However, there is a continuing need for improvement in this area. For example, many of the adjustable passive venting devices, including both the Ramsay roof jack and ventilator combination, and the Filkins chimney are somewhat difficult to adjust in the field. Other drawbacks of the prior art passive venting devices include a) being made from several cooperating parts which makes them costly to manufacture, b) being designed with a reduced net free area flow area through the vent, and c) being provided with a clumsy adjusting mechanism which presents an unclean look and provides gaps for insects and debris to accumulate. Additionally, the Ramsay roof jack/ventilator combination and the Filkins chimney are difficult to handle, heavy, and have the potential for leaks through the sheet metal seams.

SUMMARY OF THE INVENTION

What is desired is an adjustable passive roof vent which is inexpensive to manufacture and install, and which overcomes at least some of the problems associated with the prior art.

According to one aspect of the present invention there is disclosed an adjustable passive vent for venting a building enclosure having an opening in a roof portion, said adjustable passive vent comprising:

a vent structure comprising:

a collar;

a vent body attached to said collar, said vent body having a cover, and at least one gas permeable screen positioned between said cover and said collar, said at least one gas permeable screen being sized, shaped and positioned to prevent objects from passing into said vent structure;

a base pivotally attached to said vent structure at one end and being attachable to said roof portion at the other end, said base comprising:

a lower attachment structure for attaching said base to said roof portion over said opening;

an aperture through said lower attachment structure to permit gas to pass in to and out of said opening in said roof portion through said base; and a wall surrounding said aperture having a pair of opposed curvilinear wall sections configured to fit into said collar;

a pair of pivot joints pivotally attaching said aperture surrounding wall to said collar, said pivot joints defining a pivot axis about which said vent structure pivots along a range of angles relative to said base, said collar being sized and shaped to overlap portions of said aperture surrounding wall to maintain a continuous wall between said collar and said aperture surrounding wall along said range of angles;

at least one means to secure said vent structure in one of said range of angles relative to said base; and said adjustable passive vent defining a gas passageway from said at least one gas permeable screen to said aperture, to permit said gas to pass in to and out of said building enclosure through said adjustable passive vent;

wherein said adjustable passive vent may be adjusted for mounting on roof portions with different slopes.

BRIEF DESCRIPTION OF THE DRAWINGS

Reference will now be made to the preferred embodiments of the present invention with reference, by way of example only, to the following drawings in which.

DETAILED DESCRIPTION OF THE PREFERRED EMBODIMENTS

The present invention is described in more detail with reference to exemplary embodiments thereof as shown in the appended drawings. While the present invention is described below including preferred embodiments, it should be understood that the present invention is not limited thereto. Those of ordinary skill in the art having access to the teachings herein will recognize additional implementations, modifications, and embodiments which are within the scope of the present invention as disclosed and claimed herein. In the figures, like elements are given like reference numbers. For the purposes of clarity, not every component is labelled in every figure, nor is every component of each embodiment of the invention shown where illustration is not necessary to allow those of ordinary skill in the art to understand the invention.

Figure 1:
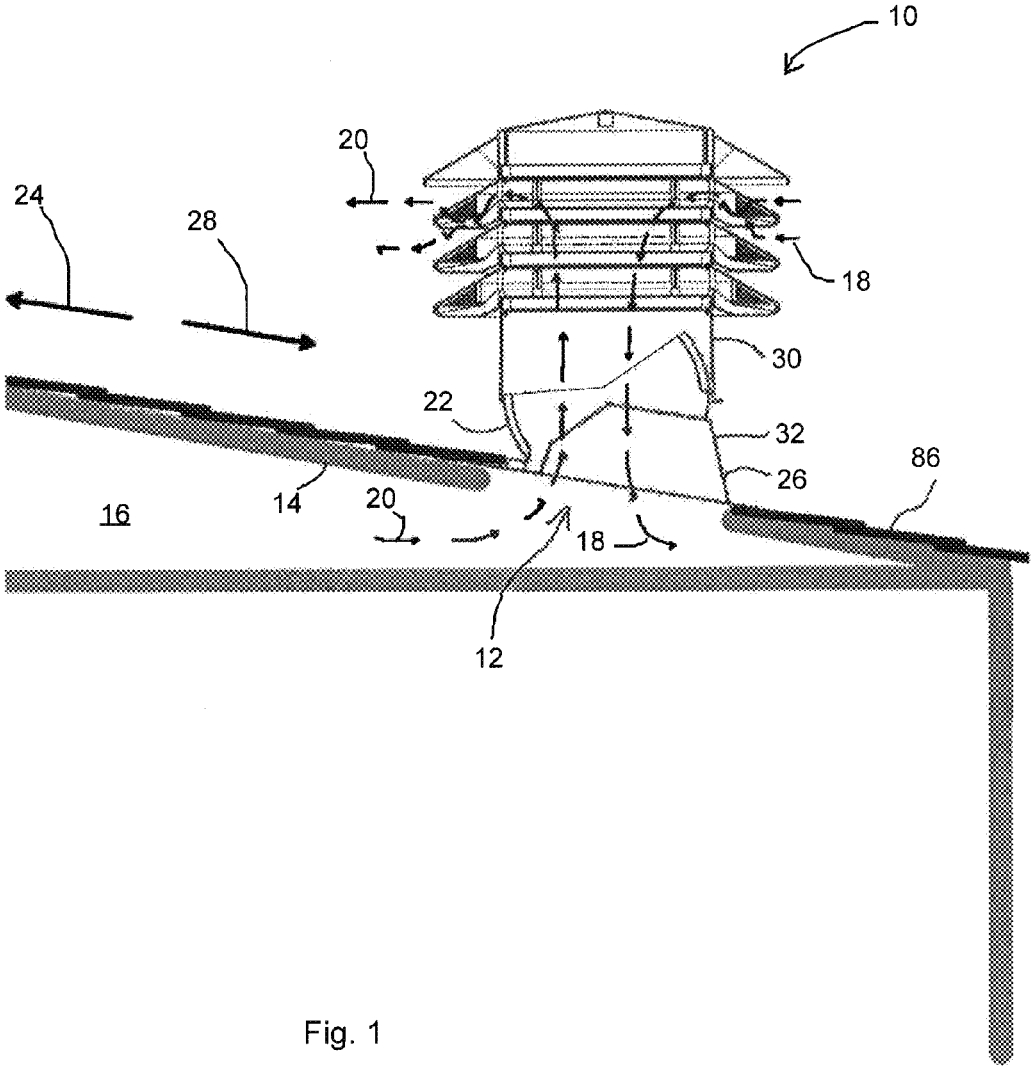
FIG. 1 is a cross-sectional view of an adjustable passive roof vent according to an embodiment of the present invention installed on a roof portion of a building enclosure.

An adjustable passive roof vent according to an embodiment of the present invention is shown generally with reference numeral 10 in FIG. 1. As shown, the adjustable passive vent 10 is installed over an opening 12 in a roof portion 14 of a building enclosure 16, such as an attic for example. As discussed in more detail below, the adjustable passive roof vent 10 is adjustable for mounting on roof portions 14 with different slopes, and configured to vent the enclosure 16 by permitting gases to pass into (represented by arrows 18) and out of (represented by arrows 20) the building enclosure 16 through the opening 12 in the roof portion 14. At the same time the adjustable passive roof vent 10 prevents objects, such as for example, moisture (i.e. rain and snow) and insects, from passing into the building enclosure 16 through the adjustable passive roof vent 10.

Preferably, the adjustable passive roof vent 10 will be manufactured from molded plastic. Moldable plastics are available which provide adequate performance in the range of weather conditions that a typical adjustable passive roof vent 10 must endure. Furthermore, the use of a plastic molding process allows a high volume of devices to be manufactured at a low per-unit cost. Thus the preferred plastics are those which can be made to conform to the shape of a suitable mold. Preferred plastics include PP and PE. Preferred molding techniques include injection molding, thermoforming, reaction injection molding, compression molding, and the like. Nevertheless, it will be appreciated that the adjustable passive roof vent 10 need not be composed of molded plastic, but may be composed of any material which allows the adjustable passive roof vent 10 to adequately perform its necessary functions. Thus, for example, the adjustable passive roof vent 10 could be composed of metal.

Figure 2:
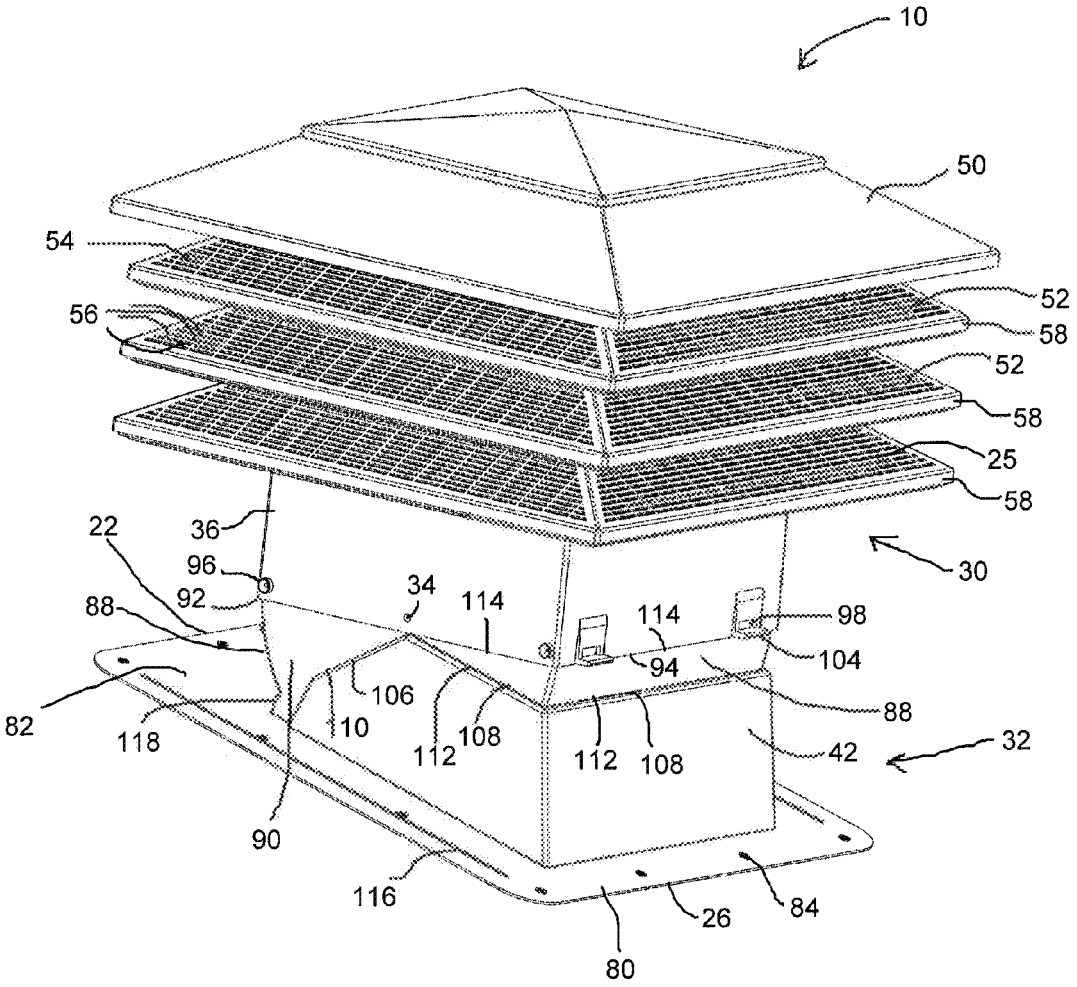
FIG. 2 is a perspective view of the adjustable passive roof vent of FIG. 1 adjusted for a roof portion having a 3/12 slope.
Figure 3:
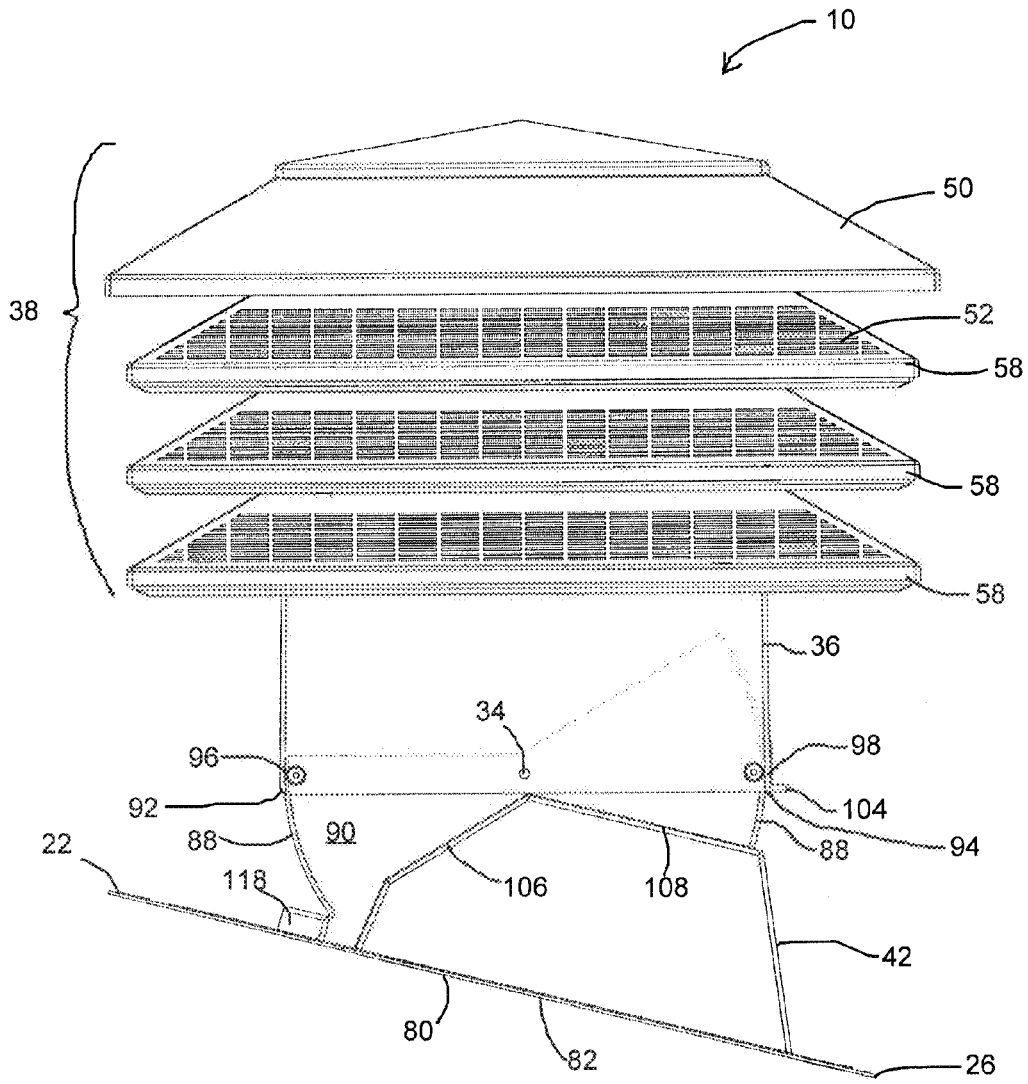
FIG. 3 is a side view of the adjustable passive roof vent of FIG. 2.
Figure 4:
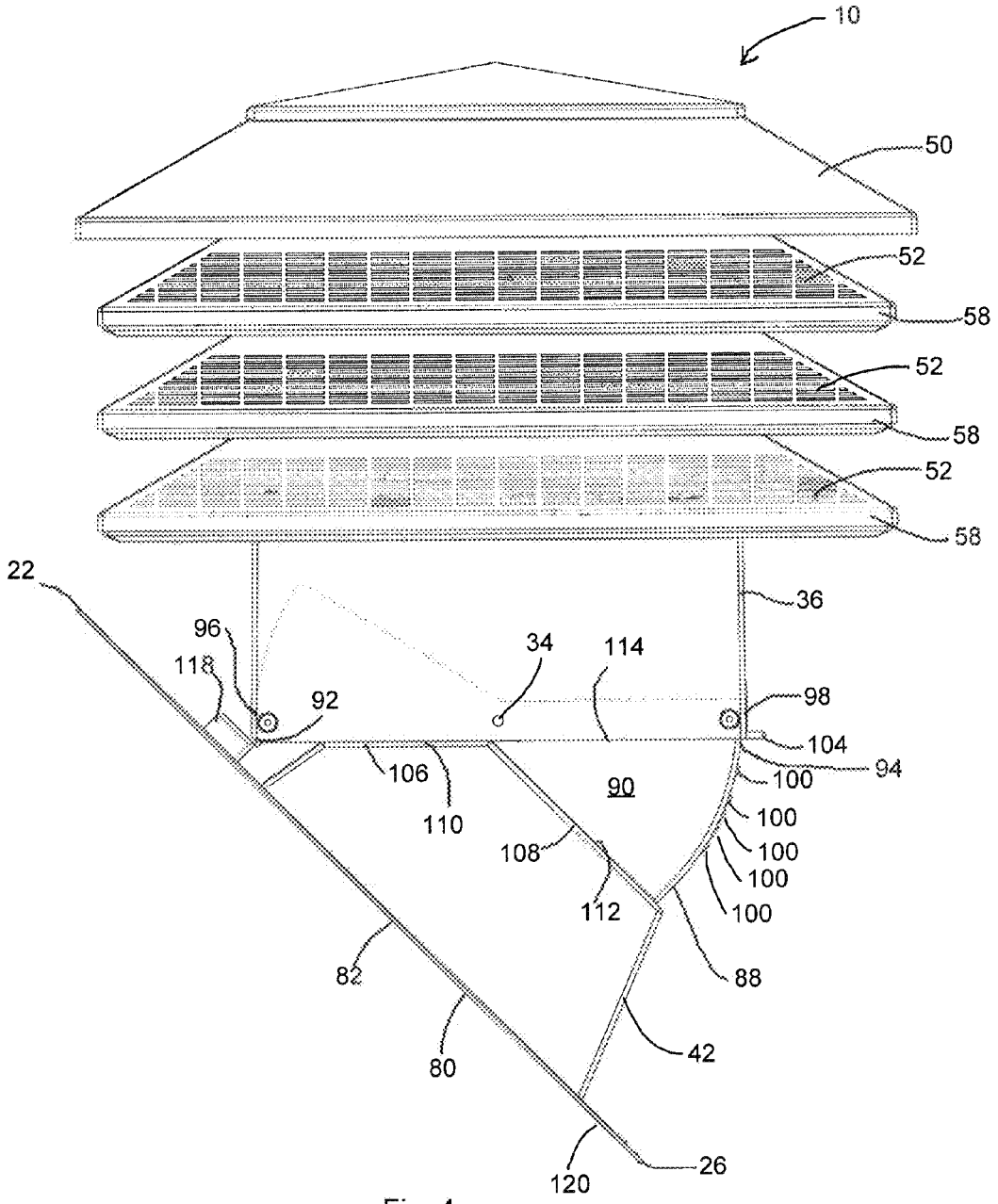
FIG. 4 is a side view of the adjustable passive roof vent of FIG. 1 adjusted for a roof portion having a 12/12 slope.

Referring now to FIGS. 2 and 3, the adjustable passive roof vent is shown adjusted for mounting to a roof portion 14 having a 3/12 (or 14.04°) slope. FIG. 4 shows the same adjustable passive roof vent adjusted for mounting to a roof portion 14 having a 12/12 (or 45°) slope. The particular embodiment of the invention shown in the figures has features discussed in more detail below which require a particular orientation of the adjustable passive roof vent in relation to the slope of the roof portion 14 to which it will be mounted. Thus, for clarity, the term upslope side 22 will be used herein to refer to the side of the vent intended to face up the slope (see arrow 24 in FIG. 1) of a sloped roof portion 14, and the term downslope side 26 will be used herein to refer to the side of the adjustable passive roof vent 10 intended to face down the slope (see arrow 28 in FIG. 1) of a sloped roof portion 14.

The adjustable passive roof vent 10 has a vent structure 30 and a base 32 which are pivotally attached together by a pair of pivot joints 34. As discussed in more detail below, the vent structure 30 has a collar 36 attached to a vent body 38, and the base 22 has an aperture 40 surrounded by a wall 42 (as best seen in FIG. 5).

Figure 5:
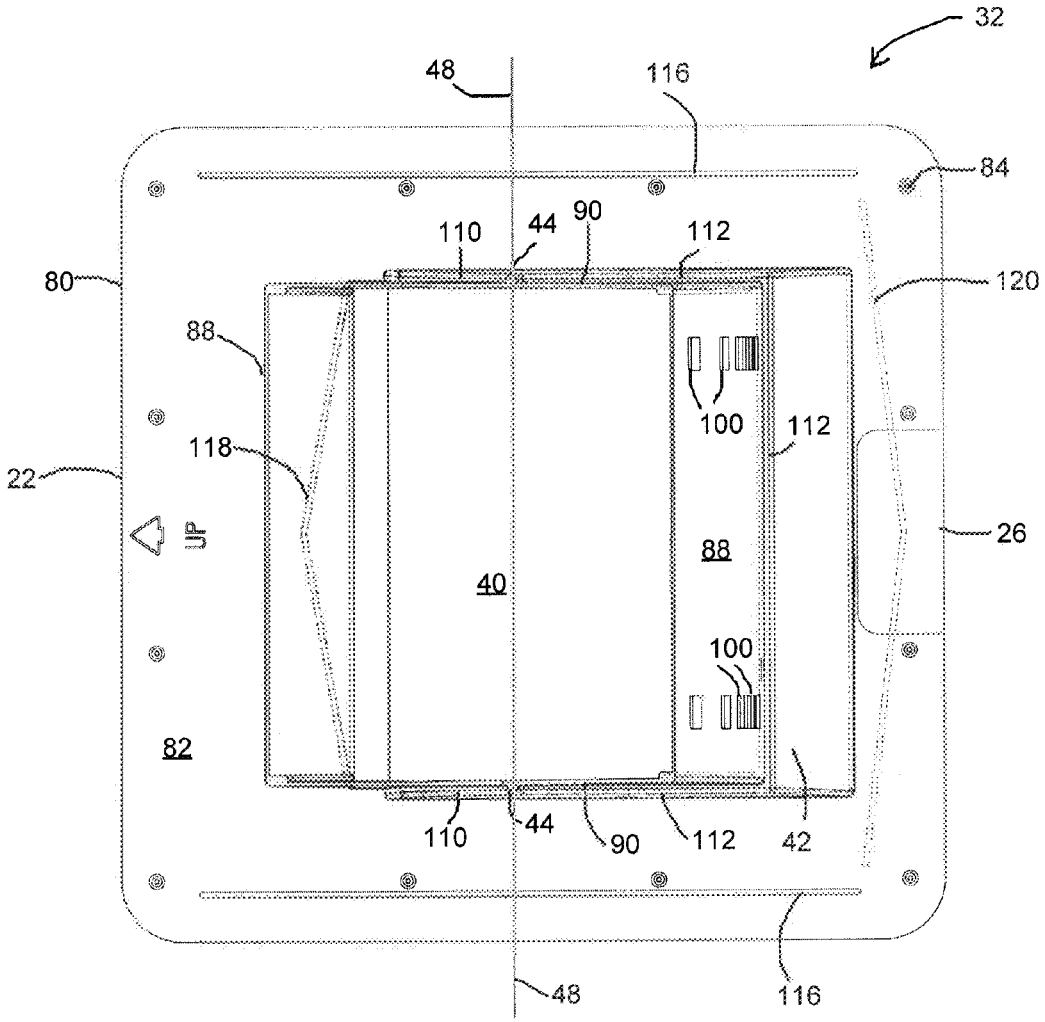
FIG. 5 is a plan view of a base of the adjustable passive roof vent of FIG. 1.
Figure 6:
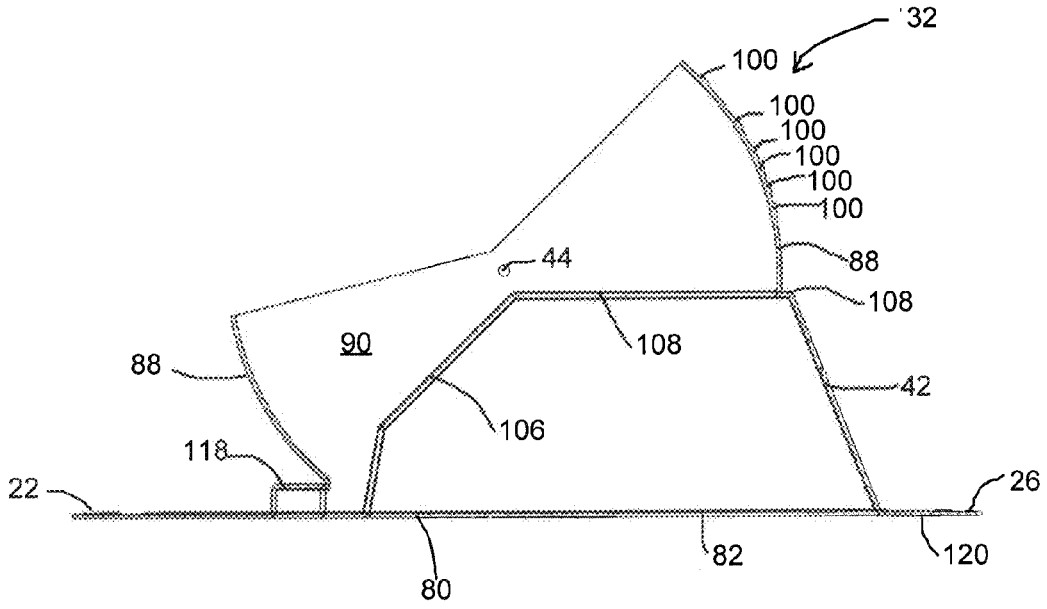
FIG. 6 is a side view of the base of FIG. 5.
Figure 7:
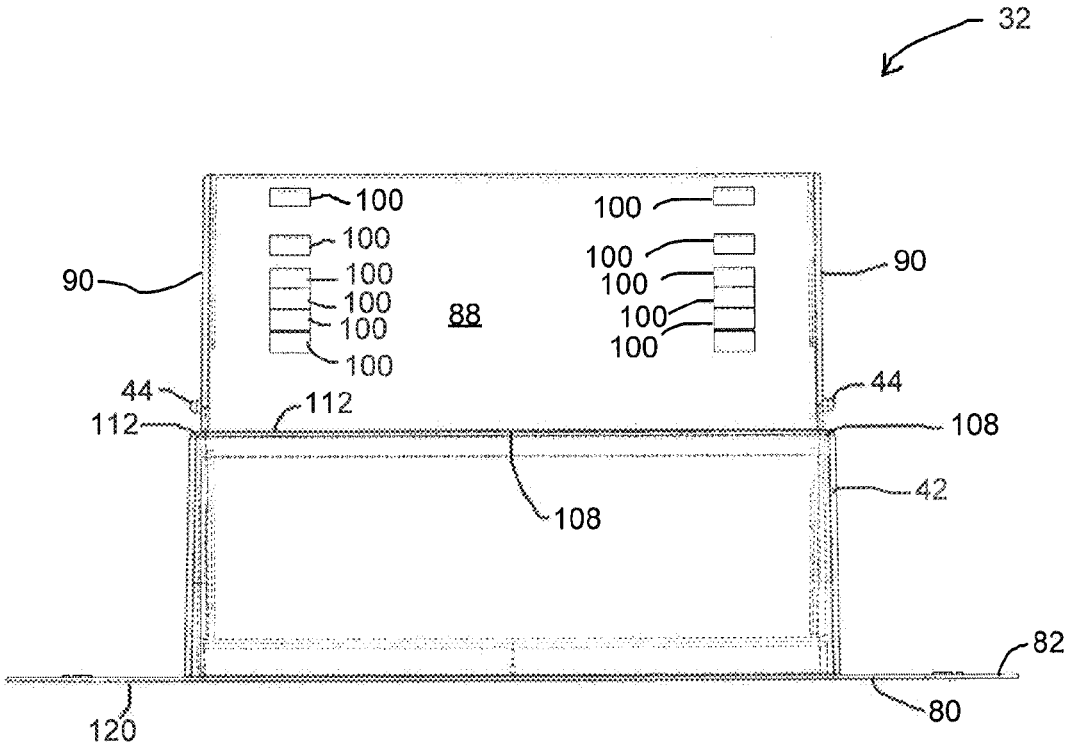
FIG. 7 is another side view of the base of FIG. 5.
Figure 10:
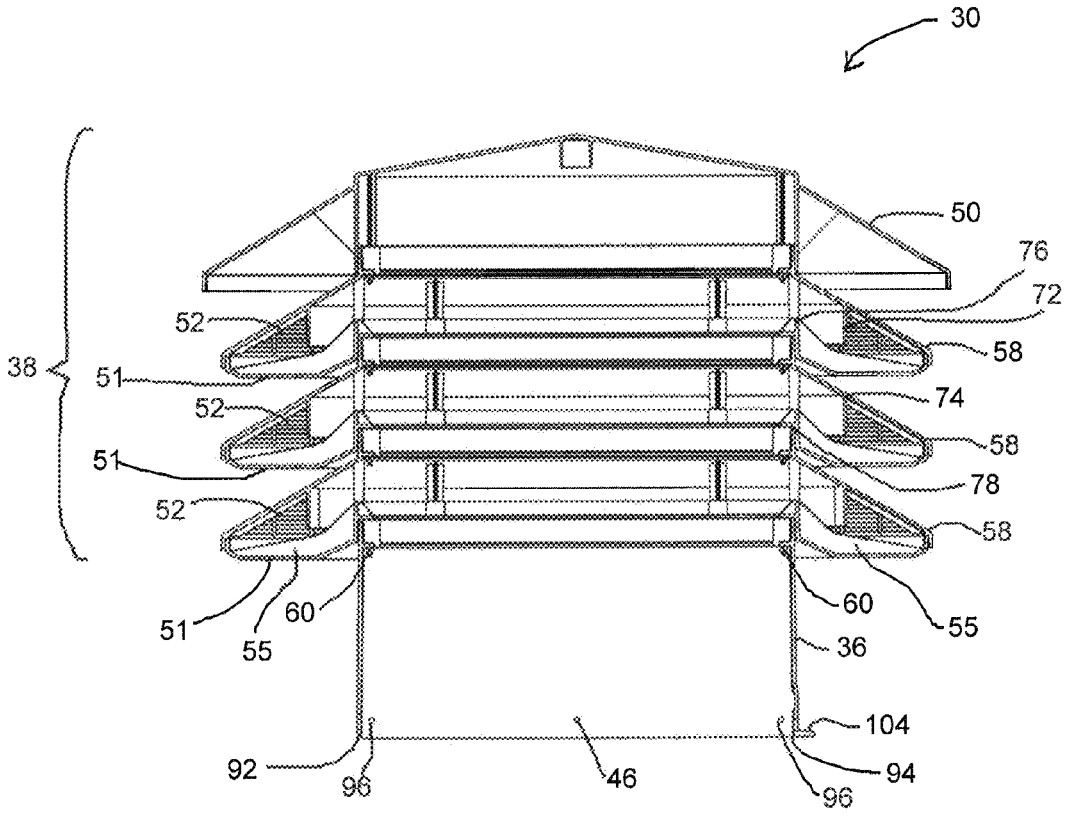
FIG. 10 is a cross-sectional view of the vent structure of FIG. 8.

Preferably, each of the pivot joints 34 is made up of a pivot pin 44 on the aperture surrounding wall 42 (as best seen in FIGS. 5 to 7), and a corresponding pivot aperture 46 on the collar 36 (as best seen in FIG. 10). However, it is also contemplated that the pivot pin 44 may instead be provided on the collar 36 with the corresponding pivot aperture 46 being provided on the aperture surrounding wall 42. Moreover, other forms of pivot joints 34 are comprehended by the present invention. What is important is that the pivot joints 34 join the collar 36 to the aperture surrounding wall 42 and define a pivot axis 48 about which the vent structure 30 pivots along a range of angles relative to the base 32, as described in detail below.

The vent body 38 includes a cover 50 and at least one gas permeable screen 52. In this example, a plurality of gas permeable screens 52 are positioned on the vent body 38 between the cover 50 and the collar 36 of the vent structure 30. However more or fewer gas permeable screens 52 are contemplated by the present invention. Preferably the at least one gas permeable screen 52 is sized, shaped and positioned on the vent body 38 to prevent objects from passing through the vent structure 30 and into the aperture 40, while at the same time allowing gas to flow out of the adjustable passive roof vent 10 to the outside. This can be accomplished by using a gas permeable screen 52 that includes a plurality of air ventilation openings 54. As seen in FIG. 2, for example, the plurality of air ventilation openings 54 can be defined by a corresponding plurality of spaced apart slats 56. The slats 56 will preferably be spaced closely enough together to prevent objects such as insects from passing through the gas permeable screen 52, while still allowing adequate air flow through the gas permeable screen 52.

Figure 13:
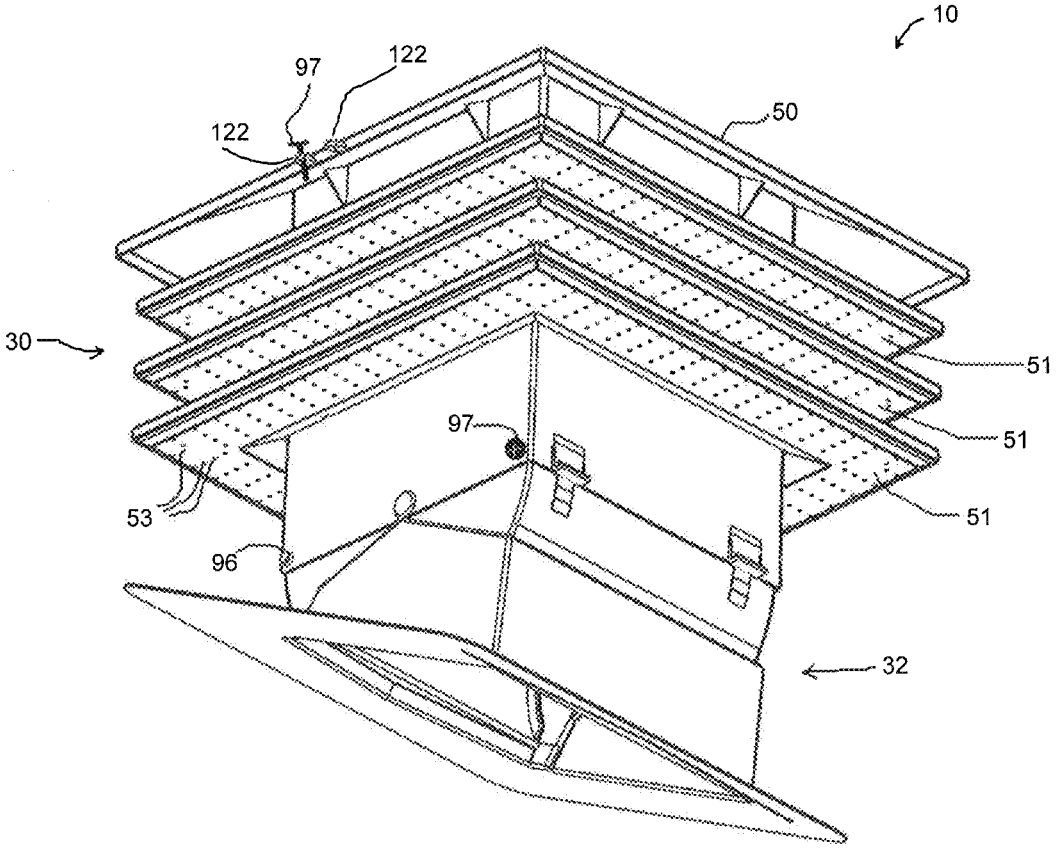
FIG. 13 is a perspective view of an adjustable passive roof vent according to another embodiment of the present invention.

As shown in FIG. 10, the preferred adjustable passive vent 10 will have a plurality of screen sections 58 arranged in stacked relation between the cover 50 and the collar 36. Although three such screen sections 58 are shown in FIG. 10, it is contemplated that more or fewer may be used according to requirements. It has been found that positioning the gas permeable screens 52 outwardly from the collar 36 with the use of screen sections 58 increases the net free air flow area through the adjustable passive roof vent 10. As best seen in FIG. 13, the bottom portions 51 of the screen sections 58 preferably include a plurality of drain openings 53 to permit water entering through the gas permeable screens 52 to drain to outside of the adjustable passive vent 10. Preferably, the bottom portions 51 of the screen sections 58 are strengthened with ribs 55.

Figure 11:
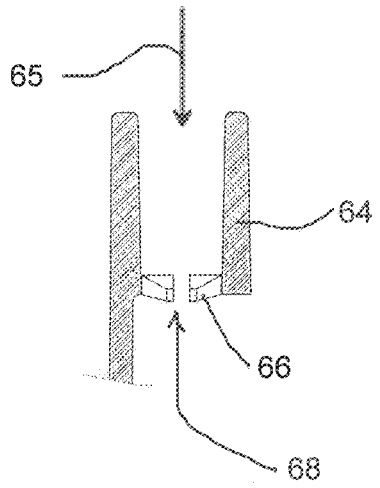
FIG. 11 is a cross-sectional view of an attachment receptacle of the adjustable roof vent of FIG. 1.
Figure 12:
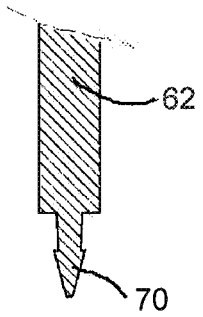
FIG. 12 is a cross-sectional view of an attachment member of the adjustable roof vent of FIG. 1.

It will be appreciated that the cover 50, the screen sections 58, and the collar 36 of the vent structure 30 may be attached together in stacked relation in any secure fashion. Conventional stake mounting has been found to be adequate. Thus, in the preferred embodiment, the cover 50, the screen sections 58, and collar 36 are attached to each other by means of attachment elements 60 as best seen in FIG. 10. The attachment elements 60 include attachment members 62 (as best seen in FIG. 12) and attachment receptacles 64 (as best seen in FIG. 11). In the preferred embodiment, the cover 50 is attached to an adjacent screen section 58 with four attachment elements 60. Similarly, each screen section 58 is attached to an adjacent screen section 58 with four attachment elements 60. The bottom screen section 58 in the stack is also attached to the adjacent collar 36 with four attachment elements 60. The attachment members 62 can be located on the bottoms of the cover 50, and the screen sections 58, with the attachment receptacles 64 located in positional agreement on the tops of the screen sections 58 and the collar 36 as shown in FIG. 10. Alternately, the attachment members 62 can be located on the tops of the screen sections 58 and the collar 36, with the attachment receptacles 64 in positional agreement on the bottoms of the cover 50, and the screen sections 58. Other arrangements of attachment members 62 and attachment receptacles 64 will also be appreciated by persons skilled in the art, all of which are contemplated by the present invention. What is important is that the attachment members 62 and attachment receptacles 64 be sized and shaped to line up with each other, such that when an attachment member 62 is inserted into an attachment receptacle 64, the attachment member 62 is gripped within the attachment receptacle 64.

To achieve a firm grip when attachment members 62 are inserted into attachment receptacles 64 in the direction of arrow 65, each attachment receptacle 64 has lips 66 at its opening defining a locking slot 68, as best seen in FIG. 11. The lips 66 are deformable outwardly when the attachment member 62 is pressed into the attachment receptacle 64 in the direction of arrow 65, but not inwardly, and are biased to return to a closed position when not being pressed on. As shown in FIG. 12, each attachment member 62 has a head 70 at its tip, the head 70 being wider than the attachment member 62 at the point of attachment between the head 70 and the attachment member 62. To attach, for example, the screen section 58 to the collar 36, the attachment members 62 are lined up with the attachment receptacles 64. The attachment heads 70 of attachment members 62 are then inserted into the locking slots 68 of attachment receptacles 64. The lips 66 deform outwardly as the attachment members 62 are inserted in the direction of arrow 65. Once the heads 70 move past the lips 66 and into the locking slots 68, the lips 66 move back to the closed position. As the lips 66 are not movable inwardly, the lips 66 hold the heads 70 in the locking slots 68 of attachment members 62, thus securely attaching the screen section 58 to the collar 36.

Referring again to FIG. 10, the screen sections 58 are preferably provided with at least one precipitation baffle 72 attached to a top wall 74. The precipitation baffle 72 is preferably sized, shaped and positioned to interfere with the entry of precipitation from the outside into the building enclosure 16 through the aperture 40, and to permit gas and vapour to flow through the aperture 40 and to the outside. In the preferred embodiment, one precipitation baffle 72 extends downwardly from the top wall 74 of each screen section 58 inwardly of the gas permeable screens 52, and a second precipitation baffle 76 extends upwardly from the bottom wall 78 of each screen section 58, interiorly of the first precipitation baffle 72. Preferably, the first precipitation baffle 72 extends far enough downward from the top wall 74 so that the lower edge of the first baffle 72 is lower than the upper edge of the second baffle 76. The first and second precipitation baffles 72, 76 are separated by an air gap, which creates a tortuous air flow pathway. The first and second precipitation baffles 72, 76, in combination with the at least one gas permeable screen 52, creates an additional tortuous air flow pathway. The tortuous air flow pathways help inhibit moisture from entering the aperture 40, while allowing exhaust air to pass through to the outside. The first and second precipitation baffles 72, 76 are, in the preferred embodiment, sized, shaped and positioned to cause precipitation entering the adjustable passive roof vent 10 through the gas permeable screen 52 to strike the precipitation baffles 72, 76 and drain outside of the adjustable passive roof vent 10. Furthermore, the tortuous pathway and associated redirections in the direction of airflow of the inflowing air causes a slowing down of influent air, allowing precipitation entrained in the air (i.e. snow and ice) to drop out of the inflowing air before it reaches the aperture 40, thereby reducing entry of moisture into the enclosure, for example, due to high wind speeds during heavy rainfall.

Referring now to FIGS. 5 to 7, the base 32 is preferably of a unitary construction and has a lower attachment structure 80 for attaching the base 32 to the roof portion 14 over the opening 12. The lower attachment structure 80 is in the form of a thin, flat, wide outer flange 82 for securing the base 32 in fluid communication with the ventilation passage through the opening 12 in the roof portion 14. The outer flange 82 preferably includes nailing features 84, such as for example holes, markings, or areas of weakness, for allowing nails to be driven through the nailing features 84 and into the roof portion 14, to secure the base 32 to the roof portion 14. The outer flange 82 permits shingles 86 to be lapped over the lower attachment structure 80, so the adjustable passive roof vent 10 is readily integrated into a shingled roof portion 14 of the building enclosure 16 in a waterproof manner.

It will be appreciated that the present invention comprehends various forms of lower attachment structures 80 other than the outer flange 82 shown for the preferred embodiment. What is important is that the adjustable passive roof vent 10 has a lower attachment structure 80 which allows the base 32 to be secured appropriately in fluid communication with the opening 12 in the roof portion 14 in order to allow venting to take place. Thus, for example, the lower attachment structure 80 may be a different shape than the wide, flat, outer flange 82 of the preferred embodiment. Also, the lower attachment structure 80 need not necessarily include, for example, the nailing features 84. Rather, the base 32 may be attached to the roof portion 14 by other suitable means, such as screws, glue or any other means that results in the base 32 being appropriately secured in fluid communication with the opening 12 through the roof portion 14 of the building enclosure 16.

The aperture 40 through the lower attachment structure 80 permits gas to pass in to and out of the opening 12 in the roof portion 14 through the base 32. As previously mentioned, a wall 42 surrounds the aperture 40. The aperture surrounding wall 42 includes a pair of opposed curvilinear wall sections 88, and a pair of opposed intermediate wall sections 90 which are disposed between the curvilinear wall sections 88. Preferably, the curvilinear wall sections 88 are parallel to the pivot axis 48 (see FIG. 5), and radiused relative to the pivot axis (see FIG. 6).

With reference to FIGS. 2 to 4, the pivot joints 34 are shown positioned at the intermediate wall sections 90 of the aperture surrounding wall 42, and the collar 36 is sized and shaped to overlap portions of the aperture surrounding wall 42. Furthermore, the configuration of the collar 36 in conjunction with the configuration of the curvilinear wall sections 88 enables the adjustable passive roof vent 10 to maintain a continuous wall between the collar 36 and the aperture surrounding wall 42 along the range of angles from 75.96° (for a 3/12 slope roof portion) to 45° (for a 12/12 slope roof portion). In other words, when the vent structure 30 pivots relative to, for example, the outer flange 82 of the base 32 along the range of angles from 75.96° to 45°, the upslope and downslope edges 92, 94 of collar 36 follow arcs spaced slightly outward from the curvilinear wall sections 88 of the aperture surrounding wall 42. This helps to eliminate gaps for insects and dirt to accumulate, provides a clean exterior look for aesthetic appeal, and maximizes a net free air flow area through the adjustable passive roof vent 10.

Of course, as shown in FIG. 1, the adjustable passive roof vent 10 defines a gas passageway (see arrows 18 and 20) from the at least one gas permeable screen 58 to the aperture 40 of the base 32 when the vent structure 30 is adjusted to one or more of the range of angles relative to the base 32, to permit the gas to pass in to and out of the building enclosure 16 through the adjustable passive roof vent 10 when the adjustable passive roof vent 10 is mounted to the roof portion 14.

Preferably at least one securement means is provided to secure the vent structure 30 in one of the range of angles relative to the base 32. One form of the securement means includes at least one securement aperture 96 in the collar 36 which is sized and shaped to permit a screw fastener 97 to pass therethrough and secure into the aperture surrounding wall 42. An example of this securement means can be seen in FIGS. 2 to 4 which illustrate two such securement apertures 96 on one intermediate wall section 90 of the collar 36. A further two securement apertures 96 may also be provided on the opposite side of the collar 36. However, it is contemplated that fewer or more securement apertures 96 may be provided on any portion of the collar 36 that overlaps with the aperture surrounding wall 42 along the range of angles.

A second form of the securement means includes at least one friction coupling 98 between the collar 36 and the aperture surrounding wall 42 for securing the vent structure 30 in at least one of the range of angles relative to the base 32.

An example of this securement means can be seen in FIG. 2 which illustrates two such friction couplings 98 between the collar 36 and aperture surrounding wall 42 on the same side as the curvilinear wall section 88 at the downslope side 26. However, it is contemplated that fewer or more friction couplings 98 may be provided between any portions of the collar 36 and aperture surrounding wall 42 that overlap along the range of angles.

Figure 8:
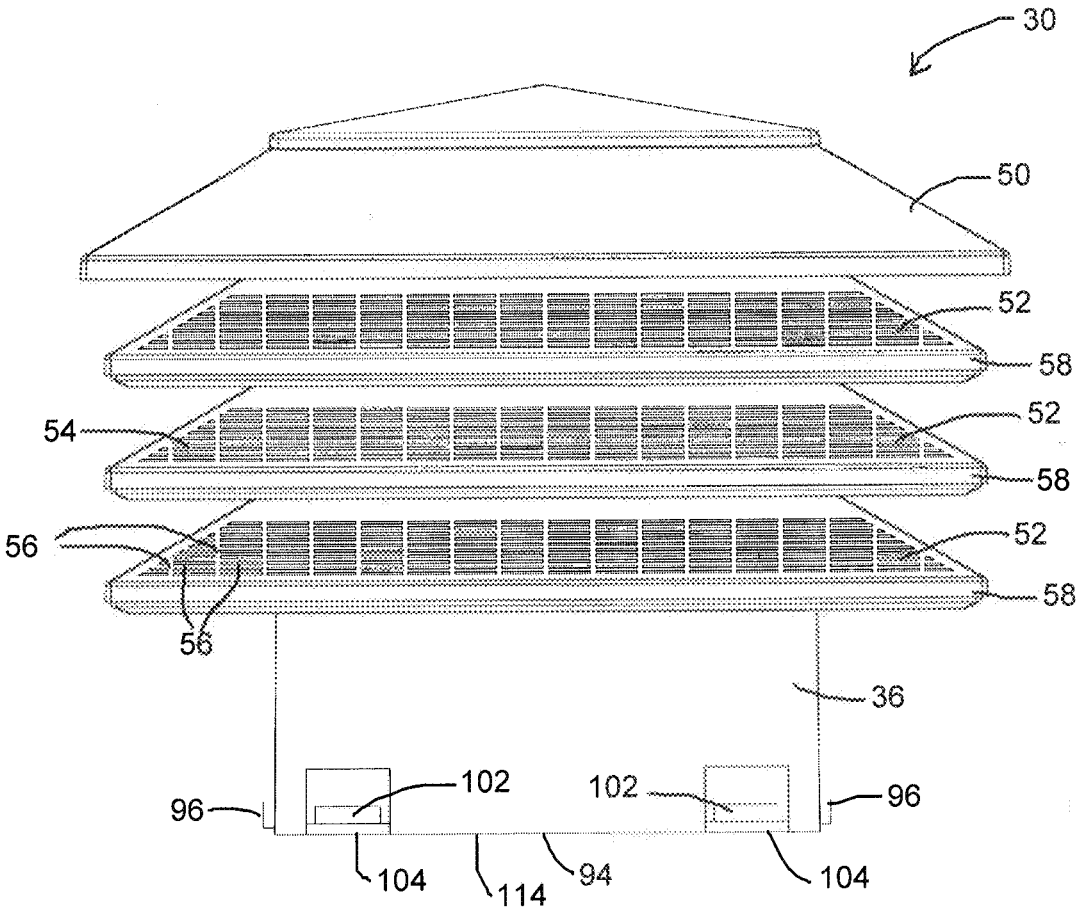
FIG. 8 is a side view of a vent structure of the adjustable passive roof vent of FIG. 1.

The preferred friction couplings 98 will now be described in more detail with reference to FIGS. 6, 7, and 8. Beginning with FIGS. 6 and 7 depicting the base 32, the curvilinear wall section 88 at the downslope side 26 of the aperture surrounding wall 42 is shown with a plurality of ramp-shaped coupling projections 100 extending therefrom. FIG. 8 depicting the vent structure 30 shows a pair of corresponding coupling apertures 102 on the collar 36 in positional agreement with a pair of respective rows of a plurality of coupling projections 100 on the aperture surrounding wall 42. However, it is also contemplated that the coupling projections 100 may have other shapes and that the coupling apertures 102 may be replaced with functionally equivalent features such as coupling voids or depressions (not shown). What is important is that at least one coupling projection 100 is provided on the aperture surrounding wall 42 to engage a corresponding feature in positional agreement on the collar 36 for securing the vent structure 30 in at least one of the range of angles relative to the base 32. However, it is contemplated that more than one friction coupling 98 may be provided between any portion of the collar 36 and aperture surrounding wall 42 that overlap along the range of angles.

For example, as best seen in FIGS. 6 and 7 the preferred embodiment of the invention includes twelve coupling projections 100 arranged in two rows on the curvilinear wall section 88 at the down slope side 26. FIG. 8 shows a pair of the corresponding coupling apertures 102 for forming two friction couplings 98 when the vent structure 30 is at one of the range of angles relative to the base 32. In this example, the coupling projections 100 are configured to form friction couplings 98 with the coupling apertures 102 when the vent structure 30 is pivoted to each of the following angles relative to the outer flange 82 of the base 32: 75.96° (for a 3/12 slope roof portion), 71.57° (for a 4/12 slope roof portion), 67.38° (for a 5/12 slope roof portion), 63.43° (for a 6/12 slope roof portion), 56.31° (for a 8/12 slope roof portion), and 45° (for a 12/12 slope roof portion). Of course other arrangements of the coupling projections 100 and coupling apertures 102 are possible, as will now be appreciated by the person skilled in the art.

Preferably the securement by the friction couplings 98 is releasable, and a lever arm 104 is provided in association with the coupling aperture 102 to facilitate decoupling the coupling aperture 102 from the coupling projection 100. The lever arm 104 is configured and arranged relative to the coupling aperture 102 to assist a user in deforming the shape of the coupling aperture 102 to allow the coupling aperture to be moved apart from the coupling projection 100 thereby decoupling the friction coupling 98.

Although the preferred embodiment of the present invention includes both the securement apertures 96 and friction couplings 98, it is contemplated that other embodiments may include only one form of securement means.

Figure 9:
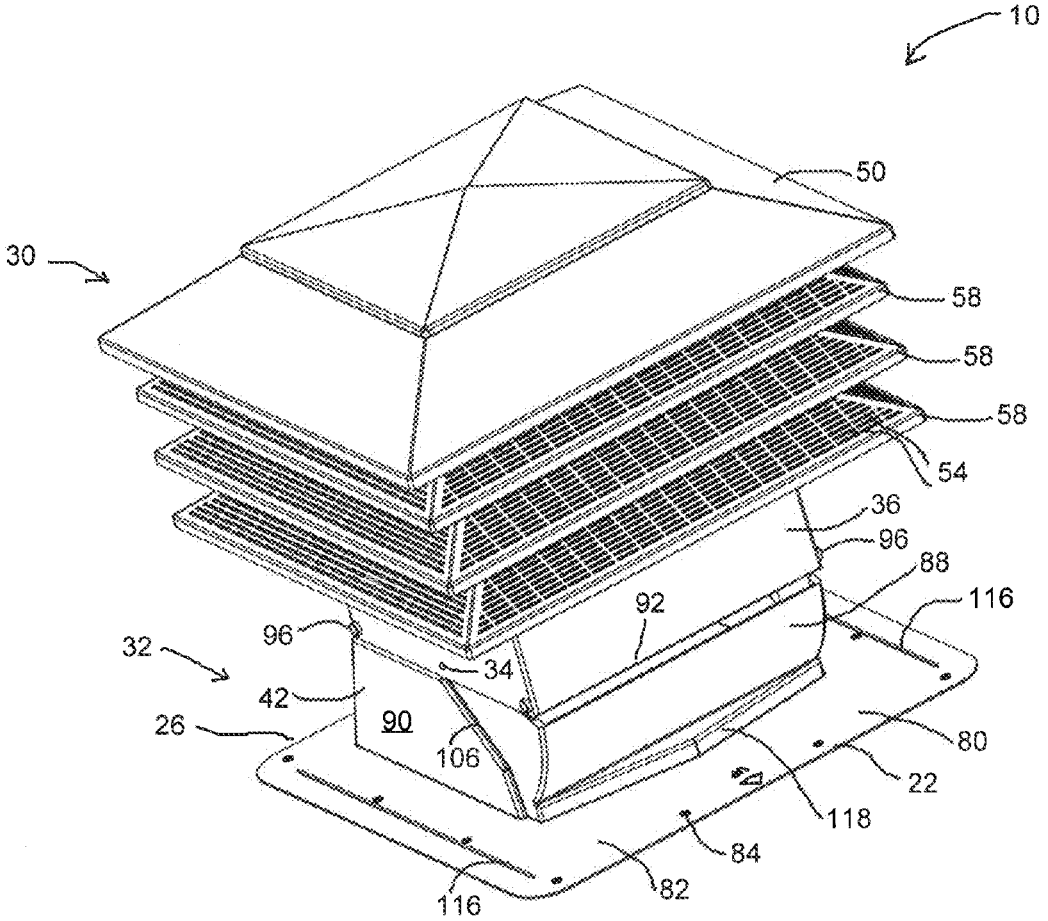
FIG. 9 is another perspective view of the adjustable passive roof vent of FIG. 1 adjusted for packaging.

Referring back to FIG. 6, the preferred adjustable passive roof vent 10 includes at least one but more preferably two limit stops 106, 108 for limiting both ends of the range of angles. In FIG. 6, the first and second limit stops 106, 108 are shown as projections extending from the aperture surrounding wall 42 configured to limit the range of angles between which the vent structure 30 can pivot relative to, for example, outer flange 82 of the base 32, in this case to between 90° and 45°. As best seen in FIG. 4, each limit stop projection 106, 108 presents an edge portion 110, 112 configured to contact a corresponding edge 114 of the collar 36 thereby preventing further pivoting of the vent structure 30 relative to the base 36. The edge portions 110, 112 of the preferred limit stops 106, 108 are linear. In FIG. 4, one linear limit stop projection 106 is positioned substantially 45° to the base to limit one end of the range of angles to 45°, which is evidenced by the fact that the vent structure 30 is oriented at a 45° angle relative to the outer flange 82 of the base 32. The other limit stop projection 108 is positioned substantially parallel to the base 32 to limit other end of the range of angles to 90° relative to the outer flange 82 of the base 32. In FIG. 9, the vent structure 30 is shown oriented perpendicular to the outer flange 82 of the base 32 at the second limit stop 108. It is contemplated that in the case of the preferred embodiment of the present invention shown in FIG. 9, the limit stop 108 for limiting the one end of the range of angles to 90° relative to the outer flange 82 of the base 32 will only be used for packaging the adjustable passive roof vent 10.

In a preferred embodiment of the invention, the base 32 also includes a raised rain ridge 116 along both sides, as best seen in FIG. 5. The purpose of the rain ridge 116 is to direct water toward the portion of the adjustable passive roof vent 10 disposed downwardly along the sloped roof portion 14. Since the downwardly disposed portion of the outer flange 82 is lapped over the shingles 86, the water is discharged off of the outer flange 82 on top of the shingles 86, thus preventing water from entering underneath the shingles 86.

In a preferred embodiment, the rain ridges 116 are molded onto the outer flange 82 during manufacturing. However, it will be appreciated by those skilled in the art that other means of forming a raised edge will provide this function. For example, the lateral edges of outer flange 82 can be bent over to form an edge channel that causes any water migrating sideways to be funnelled downwardly along the side edge and out onto the top of the shingles 86 below the adjustable passive roof vent 10.

Preferably, the base 32 also includes a liquid deflector 118. As best seen in FIG. 9, the liquid deflector 118 is positioned on the aperture surrounding wall 42 at the upslope side 22 of the adjustable passive roof vent 10. The liquid deflector 118 provides additional protection against liquid, such as rain, flowing down the sloped roof portion 14 from entering the adjustable passive roof vent 10 and into the aperture 40, by guiding the liquid to the sides of the aperture surrounding wall 42. Thus, the preferred adjustable passive roof vent 10 will be used on sloped roof portions 14 and will be installed with the liquid deflector 118, positioned on the upslope side 22 of the lower attachment structure 80 for facing up the slope of the roof portion 14 when mounted to the roof portion 14. It will be appreciated by those skilled in the art that the present invention comprehends adjustable passive roof vents 10 in which the adjustable passive roof vent 10 does not include the liquid deflector 118 described above. Furthermore, although the preferred liquid deflector 118 has a chevron shape as shown in FIG. 9, other shapes are contemplated. For example, a smoothly curved shape could be used in place of the chevron shape. It has been found that a smoothly curved continuous shape of the liquid deflector 118 facilitates the cutting of shingles to match its shape, by permitting a single continuous cut, as opposed to the two or more cuts required with, for example a chevron-shaped liquid deflector 118, such as, for example, those formed from two surfaces meeting at a peak or edge. This prevents damaging overcuts in shingles during installation, and reduces the risk of future leaks.

It has also been found that under certain conditions, water from rain, snow melt or other sources can be driven by strong winds up the slope of the roof under the bottom of the outer flange 82 of the base 32 of the adjustable passive roof vent 10 to the point that it reaches the opening 12 in the roof portion 14 and drips into the building enclosure 16. To help prevent this path of water entry, the preferred adjustable passive roof vent 10 includes a water deflector ridge 120 positioned on the underside of the base 32 as best seen in FIG. 5. The water deflector ridge 120 is raised from the bottom surface of the outer flange 82 by about 0.020 inches and positioned between the edge of the downslope side 26 of the adjustable passive roof vent 10 and the aperture 40 to abut the surface of the roof portion 14 when installed thereon. According to the preferred embodiment of the present invention the water deflector ridge 120 has a chevron-shape as shown in FIG. 5. However, it is also contemplated that the water deflector ridge 120 may have other shapes and still achieve the desired results. For example, the water deflector ridge 120 may have a curved shape. What is important is that the water deflector ridge 120 directs any water forced under the outer flange 82 to proceed up the slope of the roof between the roof portion 14 and the bottom surface of the outer flange 82 in directions away from the opening 12 in the roof portion 14. For example, the chevron-shaped water deflector ridge 120 in FIG. 5 directs the water up the slope of the roof at angles away from the opening 12. The deflected water will then drain downwardly along the slope of the roof portion 14 on top of the shingles 86.

Figure 14:
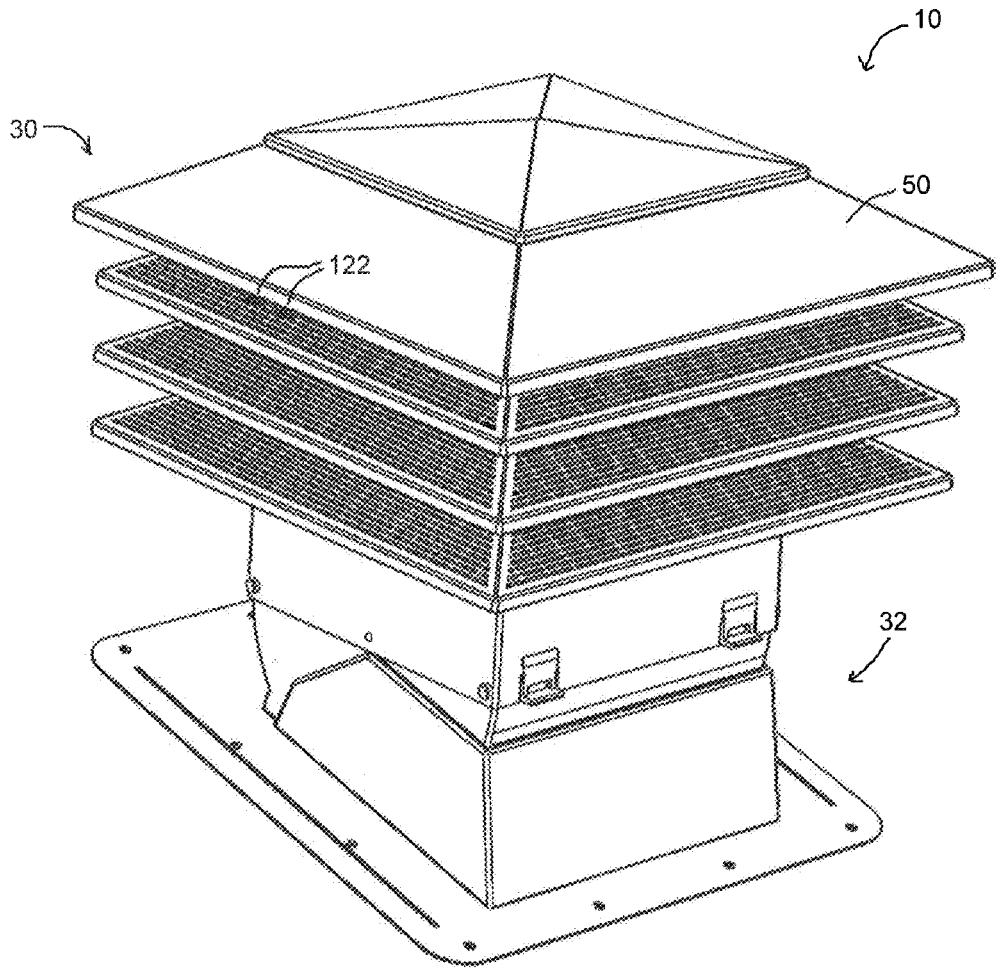
FIG. 14 is another perspective view of the adjustable passive roof vent of FIG. 13.

Referring now to FIGS. 13 and 14, there is shown another embodiment of the present invention, which includes a pair of screw fastener retainers 122 attached to one side of the cover 50 of the adjustable passive roof vent 10. Another pair of screw fastener retainers 122 is attached to the other side of the cover 50 in a similar manner. The preferred screw fastener retainers 122 have four flexible fingers that are sized, shaped and positioned to grip the body of the screw fastener 97 after it has been pushed through. The screw fastener retainers 122 are attached to the cover 50 with frangible portions, such as lines of weakness or perforations, to permit an installer in the field to easily cut or tear the screw fastener retainers 122 from the cover 50 without damaging the cover 50. The screw fastener retainers 122 are designed to hold, during for example packaging and shipping, the screw fasteners 97 which will be used in conjunction with the securement apertures 96 and aperture surrounding wall 42 to secure the vent structure 30 in at least one of the range of angles relative to the base 32. After the installer collects the screw fasteners 97 from the screw fastener retainers 122, the screw fastener retainers 122 are no longer needed and may be removed from the cover 50. Most preferably, the screw fastener retainers 122 are round so that they may be used by the installer as washers under the heads of the screw fasteners 97 when the collar 36 is being attached to the base 32, as discussed in more detail below. It will be appreciated that each screw fastener retainer 122 may be provided with fewer or more fingers, or instead of fingers a hole, a weakened area, a dimple, or a marking through which a screw fastener 97 can be pressed or screwed and then held in the screw fastener retainer 122. Furthermore, the screw fastener retainers 122 can be removably attached to any part(s) of the vent structure 30 or base 32, by molding or other means, which will allow the screw fastener retainers 122 to hold screw fasteners 97 therein, and permit the installer to remove the screw fasteners 97 and detach the screw fastener retainers 122 from the part(s). What is important is that when it is desired to provide a screw fastener retainer 122 on the adjustable passive roof vent 10, the screw fastener retainers are capable of holding the screw fasteners and can be detached from the vent structure 30 or the base 32 by tearing or cutting, without damaging the vent structure 30 or the base 32 from which they are detached.

Having described an embodiment of the present invention, a method of installing the present invention can now be described with reference to FIG. 1. First the installer will determine an appropriate location on a roof portion 14 of the building enclosure 16 for installing the adjustable passive roof vent 10. Next the installer will determine the slope of the roof portion 14. Then the installer will adjust the adjustable passive roof vent 10 in accordance with the determined slope. For example, if the slope of the roof portion 14 is determined to be 3/12 (i.e. 14.04), the installer will pivot the vent structure 30 relative to the base 32 until the desired angle is achieved. According to the preferred embodiment, the adjustable passive roof vent 10 will have friction couplings 98 permitting adjustment of the adjustable passive roof vent 10 appropriate for one or more of the more common roof slopes. As mentioned above, the preferred adjustable passive roof vent 10 will have friction couplings 98 permitting securement when the vent structure 30 is pivoted to each of the following angles relative to, for example, the outer flange 82 of the base 32: 75.96° (for a 3/12 slope roof portion), 71.57° (for a 4/12 slope roof portion), 67.38° (for a 5/12 slope roof portion), 63.43° (for a 6/12 slope roof portion), 56.31° (for a 8/12 slope roof portion), and 45° (for a 12/12 slope roof portion). The installer next drives screw fasteners 97 through one or more securement apertures 96 on the collar 36 into the aperture surrounding wall 42.

In embodiments of the adjustable passive roof vent 10 which include screw fastener retainers 122 holding the screw fasteners 97, the installer will collect the screw fasteners 97 from the screw fastener retainers 122, and tear or cut the screw fastener retainers 122 from the vent structure 30 or the base 32 (i.e. the cover 50 in the case of the embodiment in FIGS. 13 and 14). The installer will then use the screw fasteners 97 as mentioned above, except that the detached screw fastener retainers 122 may be used as washers under the heads of the screw fasteners 97.

The installer then cuts out an opening 12 in the roof portion 14, and carefully aligns the base 32 of the adjustable passive roof vent 10 over the opening 12, with the upslope side 22 facing up the slope of the roof portion 14, and the downslope side 26 facing down the slope of the roof portion 14.

The outer flange 82 is secured in place to permit the vent structure 30 to cover the opening 12 in the building enclosure 16. The outer flange 82 is installed at the same time as the roofing material is covered with weather protection, such as shingles 86. Shingles 86 are laid by starting at a low point on any surface to be protected. Then, course after course the shingles 86 are laid with the bottom of each next higher course covering the top of the course below. In this way, rain water and the like is always kept away from the underlying roofing material because for any water to get onto the same would require that the water run uphill to get over the top of the shingle course.

When encountering opening 12 in the roof portion 14, the typical procedure is to lay the course of shingles 86 up to the bottom of the opening 12, and then to interleave the outer flange 82 of the base 32 of the adjustable passive roof vent 10 in with the shingle courses. In this way the outer flange 82 at the downslope side 26 will overlie the top edge of the shingle courses 86 below it to cause water to be shed off the roof. Furthermore, the water deflector ridge 120 contacts the shingles 86 to help prevent water entry driven by strong winds up the slope of the roof as discussed above. At the upslope side 22 the outer flange 82 will underlie the bottom edge of the shingle course 86 above it.

The outer flange 82 is nailed to the roof material through nailing features 84 in the conventional manner as the shingles 86 are lapped over the outer flange 82. The shingle nails will be underneath the next overlapping shingles to prevent leaks as is conventional for such shingles.

Although the above describes adjusting the adjustable passive roof vent 10 before securing it in place to cover the opening 12 in the building enclosure 16, it is also contemplated that the installer may adjust the adjustable passive roof vent 10 in accordance with the determined slope, after it is secured in place to the roof.

The aperture 40 in base 32 is sized and shaped to be placed in registry with the opening 12 formed in the roofing material. Of course it is not required that the aperture 40 and opening 12 be exactly the same size, but the aperture 40 is necessary to permit the flow of air from one to the other in the usual manner.

While reference has been made to various preferred embodiments of the invention other variations, implementations, modifications, alterations and embodiments are comprehended by the broad scope of the appended claims. Some of these have been discussed in detail in this specification and others will be apparent to those skilled in the art. Those of ordinary skill in the art having access to the teachings herein will recognize these additional variations, implementations, modifications, alterations and embodiments, all of which are within the scope of the present invention, which invention is limited only by the appended claims.

The embodiments of the invention in which an exclusive property or privilege is claimed are defined as follows:

1. An adjustable passive vent for venting a building enclosure having an opening in a roof portion, said adjustable passive vent comprising:

a vent structure comprising:

a collar;

a vent body attached to said collar, said vent body having a cover, and at least one gas permeable screen positioned between said cover and said collar, said at least one gas permeable screen being sized, shaped and positioned to prevent objects from passing into said vent structure;

a base pivotally attached to said vent structure at one end and being attachable to said roof portion at the other end, said base comprising:

a lower attachment structure for attaching said base to said roof portion over said opening;

an aperture through said lower attachment structure to permit gas to pass in to and out of said opening in said roof portion through said base; and a wall surrounding said aperture having a pair of opposed curvilinear wall sections configured to fit into said collar;

a pair of pivot joints pivotally attaching said aperture surrounding wall to said collar, said pivot joints defining a pivot axis about which said vent structure pivots along a range of angles relative to said base, said collar being sized and shaped to overlap portions of said aperture surrounding wall to maintain a continuous wall between said collar and said aperture surrounding wall along said range of angles;

at least one means to secure said vent structure in one of said range of angles relative to said base; and said adjustable passive vent defining a gas passageway from said at least one gas permeable screen to said aperture, to permit said gas to pass in to and out of said building enclosure through said adjustable passive vent;

wherein said adjustable passive vent may be adjusted for mounting on roof portions with different slopes.

2. The adjustable passive vent as claimed in claim 1, wherein said base further comprises at least a first limit stop for limiting one end of said range of angles.

3. The adjustable passive vent as claimed in claim 2, wherein said base further comprises a second limit stop for limiting a second end of said range of angles.

4. The adjustable passive vent as claimed in claim 3, wherein said first and second limit stops limit said range of angles to about 90° to about 45° relative to said base.

5. The adjustable passive vent as claimed in claim 3, wherein each of said first and second limit stops comprise a projection from said aperture surrounding wall, each said projection presenting an edge portion configured to contact a corresponding edge of said collar thereby preventing further pivoting of said vent structure relative to said base.

6. The adjustable passive vent as claimed in claim 5, wherein each said edge portion is linear.

7. The adjustable passive vent as claimed in claim 6, wherein said linear edge portion of said first limit stop is substantially parallel to said attachment structure of said base.

8. The adjustable passive vent as claimed in claim 6, wherein said linear edge portion of said second limit stop is substantially 45° to said attachment structure of said base.

9. The adjustable passive vent as claimed in claim 1, wherein said at least one gas permeable screen comprises a plurality of air ventilation openings.

10. The adjustable passive vent as claimed in claim 9, wherein said plurality of air ventilation openings are defined by a plurality of spaced apart slats.

11. The adjustable passive vent as claimed in claim 1, wherein said attachment structure includes a substantially flat outer flange sized and shaped to permit shingles to be lapped thereover.

12. The adjustable passive vent as claimed in claim 11, further comprising a rain ridge sized, shaped, and positioned on the flange, so as to direct water that is under the shingles out from under the shingles and down a slope.

13. The adjustable passive vent as claimed in claim 1, wherein said base has an upslope side configured to face upward along a sloped roof portion, said base further comprising a liquid deflector positioned on said upslope side, for deflecting liquid flowing downward along said sloped roof portion, away from said aperture.

14. The adjustable passive vent as claimed in claim 1, wherein each of said pivot joints comprises a pivot pin on one of said collar and said aperture surrounding wall, and a corresponding pivot aperture on the other of said collar and said aperture surrounding wall.

15. The adjustable passive vent as claimed in claim 1, wherein said at least one securement means comprises at least one securement aperture in said collar, said securement aperture being sized and shaped to permit a screw fastener to pass therethrough into said aperture surrounding wall.

16. The adjustable passive vent as claimed in claim 1, wherein said at least one securement means comprises at least one friction coupling between said collar and said aperture surrounding wall for securing said vent structure in at least one of said range of angles relative to said base.

17. The adjustable passive vent as claimed in claim 16, comprising a plurality of friction couplings between said collar and said aperture surrounding wall for securing said vent structure in a plurality of said range of angles relative to said base.

18. The adjustable passive vent as claimed in claim 16, wherein said at least one range of angles comprises one or more of about 90°, about 76°, about 71.6°, about 67.4°, about 63.4°, about 56.3°, and about 45°.

19. The adjustable passive vent as claimed in claim 16, wherein said at least one friction coupling comprises a projection on one of said collar and said aperture surrounding wall, and a corresponding depression or aperture on the other of said collar and said aperture surrounding wall.

20. The adjustable passive vent as claimed in claim 19, further comprising a lever arm associated with said depression or aperture to facilitate decoupling of said at least one friction coupling.

21. The adjustable passive vent as claimed in claim 19, wherein said at least one friction coupling comprises said projection, and said projection is positioned on said curvilinear wall section of said aperture surrounding wall.

22. The adjustable passive vent as claimed in claim 1, wherein said vent body comprises a screen section between said cover and said collar, said screen section comprising said at least one gas permeable screen, said at least one gas permeable screen being positioned outwardly from said collar to increase a net free air flow area.

23. The adjustable passive vent as claimed in claim 22, comprising a plurality of screen sections arranged in stacked relation between said cover and said collar.

24. The adjustable passive vent as claimed in claim 23, wherein each of said screen sections comprises at least one baffle attached thereto, inwardly of said at least one gas permeable screens to create a tortuous air flow pathway to help inhibit moisture from entering said aperture while allowing exhaust air to pass through from the building to outside of said vent.

25. The adjustable passive vent as claimed in claim 24, wherein said moisture comprises snow or rain.

26. The adjustable passive vent as claimed in claim 22, wherein said screen section further comprises a plurality of drain openings on one or more bottom portions of said screen section to permit moisture entering through the gas permeable screen to drain to outside of the adjustable passive vent, said plurality of drain openings being positioned outwardly from said collar.

27. The adjustable passive vent as claimed in claim 1, wherein said collar and said aperture surrounding wall are rectangular in plain view.

28. The adjustable passive vent as claimed in claim 1, formed from moulded plastic.

29. The adjustable passive vent as claimed in claim 1, wherein said base is of unitary construction.

30. The adjustable passive vent as claimed in claim 1, wherein said curvilinear wall sections are parallel to said pivot axis.

31. The adjustable passive vent as claimed in claim 1, wherein said curvilinear wall sections are radiused relative to said pivot axis.

32. The adjustable passive vent as claimed in claim 1, further comprising at least one screw fastener retainer detachably attached to said vent structure or said base by a frangible portion.

* * * * *